US007226046B2

(12) United States Patent
Kloepfer et al.

(10) Patent No.: US 7,226,046 B2
(45) Date of Patent: Jun. 5, 2007

(54) EXTENSION DEVICE FOR A CLAMPING AND SPREADING DEVICE AND CLAMPING AND SPREADING DEVICE

(75) Inventors: Gerhard Kloepfer, Pleidelsheim (DE); Karl Philipp, Bietigheim-Bissingen (DE); Hans Roesch, Gemmrigheim (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 115 days.

(21) Appl. No.: 11/066,343

(22) Filed: Feb. 24, 2005

(65) Prior Publication Data

US 2006/0049563 A1 Mar. 9, 2006

(30) Foreign Application Priority Data

Sep. 8, 2004 (DE) ..... 20 2004 014 121

(51) Int. Cl.
*B25B 1/24* (2006.01)

(52) U.S. Cl. ..... 269/6

(58) Field of Classification Search ..... 269/3, 269/6, 228, 203–206, 147–149, 166; 81/487; 254/DIG. 1, DIG. 4, 134, 133, 133 A
See application file for complete search history.

(56) References Cited

U.S. PATENT DOCUMENTS

| | | | | |
|---|---|---|---|---|
| 3,096,975 | A | 7/1963 | Irwin | |
| 4,185,811 | A | 1/1980 | Long | |
| 4,257,584 | A | 3/1981 | Sterling | |
| 5,215,288 | A * | 6/1993 | Lyon | 254/133 A |
| 5,593,147 | A | 1/1997 | Read | |
| 6,152,434 | A | 11/2000 | Gluck | |
| 6,575,442 | B2 | 6/2003 | Klimach et al. | |
| 6,736,371 | B1 * | 5/2004 | Burrows | 254/133 A |

* cited by examiner

*Primary Examiner*—Robert C. Watson
(74) *Attorney, Agent, or Firm*—Lipsitz & McAllister, LLC

(57) ABSTRACT

An extension device for a clamping and spreading device with a slide rail guided for displacement relative to a bearing device is suggested which has at least one contact element for a workpiece and is fixed or can be fixed in position so as to be non-translational in relation to the bearing device.

34 Claims, 7 Drawing Sheets

EXTENSION DEVICE FOR A CLAMPING AND SPREADING DEVICE AND CLAMPING AND SPREADING DEVICE

The present disclosure relates to the subject matter disclosed in German application No. 20 2004 014 121.3 of Sep. 8, 2004, which is incorporated herein by reference in its entirety and for all purposes.

BACKGROUND OF THE INVENTION

The invention relates to an extension device for a clamping and spreading device said clamping and spreading device having a bearing device and a slide rail guided for displacement in relation to the bearing device.

The invention relates, in addition, to a clamping and spreading device comprising a bearing device and a slide rail guided for displacement in relation to the bearing device.

Such clamping and spreading devices are known, for example, from WO 01/56747 A1 or U.S. Pat. No. 6,575,442 B2 or German patent application No. 10 2004 013 066.3 of Mar. 12, 2004 which is not a prior publication.

SUMMARY OF THE INVENTION

With embodiments of the present invention, the possibilities for using the clamping and spreading device can be broadened.

In accordance with the invention, the extension device has at least one contact element for a workpiece and is fixed or can be fixed in position so as to be non-translational in relation to the bearing device.

The slide rail is movable relative to the bearing device. As a result of the inventive extension device being fixed in position on the clamping and spreading device, namely in such a manner that this is non-translational in relation to the bearing device, the slide rail may be displaced relative to the at least one contact element of the extension device when an extension device is fixed in position and may, for example, be displaced into a clamping position or spreading position.

An additional contact element, via which the clamping width and spreading width may be enlarged, can be made available to the clamping and spreading device via the extension device. The clamping width and spreading width is no longer dependent on the length of the slide rail on account of the extension device.

For example, it is possible as a result to carry out a spreading procedure in a body.

Particularly when the extension device can be releasably fixed in position on the clamping and spreading device, broader possibilities of use result, wherein the provision of new features is possible in a simple manner. The extension device may be produced in an inexpensive manner.

It is also, in principle, possible to produce the extension device in an adapted length or make a set of extension devices of different lengths available or provide an extension device with a variable length. This results in an optimized adaptability to corresponding applications.

The extension device is designed, in particular, such that a clamping width and/or spreading width of the clamping and spreading device with an extension device fixed in position is increased in comparison with the clamping and spreading device without an extension device. This results in broader possibilities for use. In particular, a spreading procedure in the body is possible.

Furthermore, it is favorable when the extension device is designed such that with an extension device fixed in position on the clamping and spreading device an outer end of the combination of clamping and spreading device and extension device is formed to one side on the extension device.

In the case of clamping and spreading devices such as those known from the state of the art (WO 01/56747 A1 or U.S. Pat. No. 6,575,442 B2 or the German patent application No. 10 2004 013 066.3 of Mar. 12, 2004), an end is determined by the slide rail. When the slide rail is drawn out of the bearing device, the clamping and spreading device is no longer operable. As a result of the inventive extension device, the end of the clamping and spreading device may be formed on the extension device in the combination of clamping-spreading device and extension device. As a result, the maximum possible clamping width and spreading width is no longer determined by the maximum path of displacement of the slide rail but rather by the maximum possible distance between a contact element seated on the slide rail and the at least one contact element of the extension device. When the end is formed via the extension device and, in particular, is formed by means of a contact element, outer, oppositely located elements of the combination of clamping and spreading device and extension device are formed via contact elements. As a result, it is, for example, possible to carry out a spreading procedure in a body: A contact element of the clamping and spreading device can abut on a first wall and a contact element of the extension device can abut on a second wall located opposite thereto. When the slide rail is moved away from the contact element of the extension device, a spreading force is exerted on the first wall and the second wall.

The at least one contact element is arranged and/or formed, in particular, at or in the vicinity of an outer end of the extension device. As a result, a spreading procedure in the body may, for example, be carried out.

It is, in principle, possible for the at least one contact element to be designed as a contact area (contact surface) which does not project beyond an extension element of the extension device. It may also be provided for the at least one contact element to be designed as a transverse bar which projects beyond a longitudinal axis of the extension element in one direction or in a first direction and in an opposite direction. As a result, it is, for example, also possible to carry out clamping procedures with an increased clamping width. Broader application possibilities result therefrom.

It is favorable, for example, when the at least one contact element of the extension device has a first contact area and a second contact area located opposite thereto. As a result, this contact element can be used for spreading procedures and for clamping procedures.

An extension element extending in a direction of a longitudinal axis is provided, in particular. This extension element determines the maximum possible clamping width or spreading width via its length. It may be designed in one piece or several pieces. It may be an element with a fixed length or its length can be variably adjusted.

It is favorable when the at least one contact element is arranged and/or formed on the extension element. The extension device may, as a result, be designed in a simple manner and, therefore, be produced inexpensively and also used in a simple manner.

In principle, it is possible for the at least one contact element to be arranged on the extension element so as to be movable and securable. For example, the at least one contact element can be arranged so as to be displaceably securable and/or rotatably securable. As a result, it is possible to bring the contact element into a predetermined relative position on the extension element, should this be necessary for a corresponding application. It is, however, also possible for the at least one contact element to be seated rigidly on the extension element.

It is particularly advantageous when the extension element is designed such that a relative displacement movement of the slide rail in relation to the extension element is not hindered. The extension device may be fixed in position so as to be non-translational with respect to the bearing device. The slide rail moves relative to the bearing device and, therefore, also relative to the extension element when an extension device is fixed in position. With a corresponding design of the extension element, broader application possibilities result since an extension of the clamping width or spreading width is provided for.

It is favorable when the extension element is of a tubular design. Such an extension element may be produced in a simple manner. A space is then made available, in which a collision-free guidance of the slide rail is possible.

The extension element has, in particular, an inner space, into which the slide rail can dip. This inner space can accommodate the slide rail when this is displaced in the direction of the at least one contact element of the extension device.

It may be provided for the length of the extension element itself to be variably adjustable. As a result, the length of the extension device can be adjusted. In particular, the distance of the at least one contact element from an end of the extension device, via which this is fixed or can be fixed in position on the clamping and spreading device, can be adjusted. The change in length refers to at least a minimum length of the extension element, i.e., proceeding from the minimum length the length may be variably adjusted up to a maximum length. The adjustability of the length may be continuous or be provided in steps. For example, a telescope type of adjustability of the length is possible. For this purpose, the longitudinal extension element comprises, for example, at least two tubular elements, wherein the one tubular element is guided in the other tubular element. The relative position of the two tubular elements may be adjusted in a secure manner, wherein a secure fixing in position (and, therefore, setting of a specific length of the extension element) may be provided, for example, via a retaining element.

At least one guide element is favorably provided for the slide rail and this element is designed such that a relative rotation between slide rail and the extension device is essentially blocked when a slide rail is located in the guide element. As a result, a simple fixing in position of the extension device with respect to the bearing device can be achieved. For example, only a translational fixing in position need still be taken care of. Due to the fact that the slide rail dips into the guide recess, it is automatically secured against any rotation. The guide recess is normally designed such that the slide rail is guided in it with clearance. As a result, a rotatability at a small angle is possible. This is, however, so slight that the fixing in position of the extension device with respect to the bearing device is not released.

It is particularly advantageous when a releasable fixing in position of the extension device in relation to the bearing device is provided. The extension device may then be fixed in position as required. For example, it is also possible for a set of extension devices of different lengths to be provided in order to use the appropriate extension device as required by the application.

It is favorable when a coupling for fixing the extension device in position in relation to the bearing device is provided. A releasable connection between the clamping and spreading device and the extension device may be provided in a simple manner via the coupling.

At least one guide element for the slide rail is, in particular, arranged and/or formed on the coupling. The guide element may be integrated into the coupling. As a result, the extension device may be produced in a simple and inexpensive manner.

The coupling is seated, in particular, on an extension element. The coupling is produced, for example, from plastic and is subsequently fixed in position on the extension element.

It may be provided for the coupling to be designed such that the extension device can be fixed in position in relation to the bearing device in at least two different positions of the at least one contact element relative to the bearing device. This can be advantageous when the contact element is not of a symmetric design and has, for example, a greater extension in one direction than in another direction. An adaptation to the respective application is then possible.

A simple fixing and releasing of the fixing in position may be achieved when the coupling is designed such that it can be turned onto a fixing area of the clamping and spreading device. A blocking of translational movement with a blocking of rotational movement may be achieved in a simple manner in combination with a guide element for securing against any rotation.

The coupling has, in particular, at least one flange for engaging over a fixing area of the clamping and spreading device. With corresponding positioning, the translational movement of the clamping and spreading device away from the extension device and vice versa may, as a result, be blocked.

It is favorable, in particular, when two flanges located opposite one another are provided. As a result, any tilting movement of the extension device in relation to the clamping and spreading device may be prevented.

The coupling is, for example, pushed or shrunk onto the extension element. This results in simple and inexpensive production possibilities.

Embodiments of a clamping and spreading device in accordance with the invention have the advantages already explained in conjunction with the extension device in accordance with the invention.

The displacement movement of the slide rail can be actuated, in particular, in a clamping direction with blocking of the displaceability in an opposite direction and the displacement movement can be actuated in a spreading direction with blocking of the displaceability in the opposite direction, wherein the displacement movement can be switched over between clamping direction and spreading direction via a changeover device. As a result, a clamping and spreading device can be designed in a simple manner, wherein, depending on the direction of movement of the slide rail, it is determined whether a clamping procedure or a spreading procedure is carried out. Corresponding clamping and spreading devices are known from WO 01/56747 A1 or U.S. Pat. No. 6,575,442 B2 and from German patent application No. 10 2004 013 066.3 of Mar. 12, 2004, which is not a prior publication.

A first contact element is arranged, in particular, on the slide rail. This contact element is seated securely on the slide rail and is movable with it. The contact element is preferably designed as a transverse bar.

It is, in addition, preferably provided for a second contact element to be arranged so as to be non-translational in relation to the bearing device. Clamping procedures and spreading procedures may be carried out via the first contact element and the second contact element. The application possibilities are broadened in accordance with the invention due to the fact that at least one additional contact element is provided via the extension device.

The at least one contact element of the extension device can have a greater height in at least one direction than the first contact element and/or the second contact element in relation to a longitudinal axis of the slide rail when an extension device is fixed in position. As a result, an enlarged contact area or surface can be made available which can be advantageous for specific applications.

It can also be favorable when the at least one contact element of the extension device has essentially the same height in at least one direction as the first contact element and/or the second contact element in relation to a longitudinal axis of the slide rail when an extension device is fixed in position. As a result, the clamping and spreading device with an extension device fixed in position may be placed flat on a flat base.

It is favorable when a coupling or a counter-coupling non-translational in relation to the bearing device is provided for a releasable fixing in position of the extension device. The coupling of the clamping and spreading device interacts with a counter-coupling of the extension device or vice versa a coupling of the extension device interacts with a counter-coupling of the clamping and spreading device. As a result, a connection may be brought about or released in a simple manner.

It is particularly favorable when a and, in particular, a single gripping lever is provided for actuation of the displacement of the slide rail. The slide rail may be displaced due to pivoting of the gripping lever and, as a result, a clamping movement or spreading movement (depending on the direction of displacement of the slide rail) may be effected. As a result, a one-handed operation may, in particular, be ensured. The clamping and spreading device may be designed as a one-handed clamp as a result.

Furthermore, it is favorable when a counter-gripping element to the gripping lever is provided, on which the slide rail is guided. As a result, a secure hold results as well as a simple actuating operation (for the displacement of the slide rail) for an operator. Furthermore, a large bearing surface distance is made available and so a good guidance of the slide rail is ensured.

It is provided, in particular, for the extension device to be fixed or fixable on the counter-gripping element. The counter-gripping element is normally the furthest outlying area of the bearing device or the components, which are connected to the bearing device in a non-translational manner. The counter-gripping element is oriented along the slide rail. The extension device may be fixed to the counter-gripping element in a simple manner, wherein the extension device can again be designed in a simple manner.

For example, the counter-gripping element has as coupling or counter-coupling for the extension device at least one edge bead for fixing the extension device in position. A blocking of the translational movement of the extension device and the counter-gripping element relative to one another may be brought about via the edge bead when the counter-gripping element and the coupling are positioned accordingly relative to one another.

An extension element of the extension device favorably extends essentially parallel or coaxially to the slide rail when an extension device is fixed in position. As a result, the clamping width and spreading width may be increased in an effective manner via the extension device.

The following description of a preferred embodiment serves to explain the invention in greater detail in conjunction with the drawings.

DETAILED DESCRIPTION OF THE INVENTION

Figure 1:
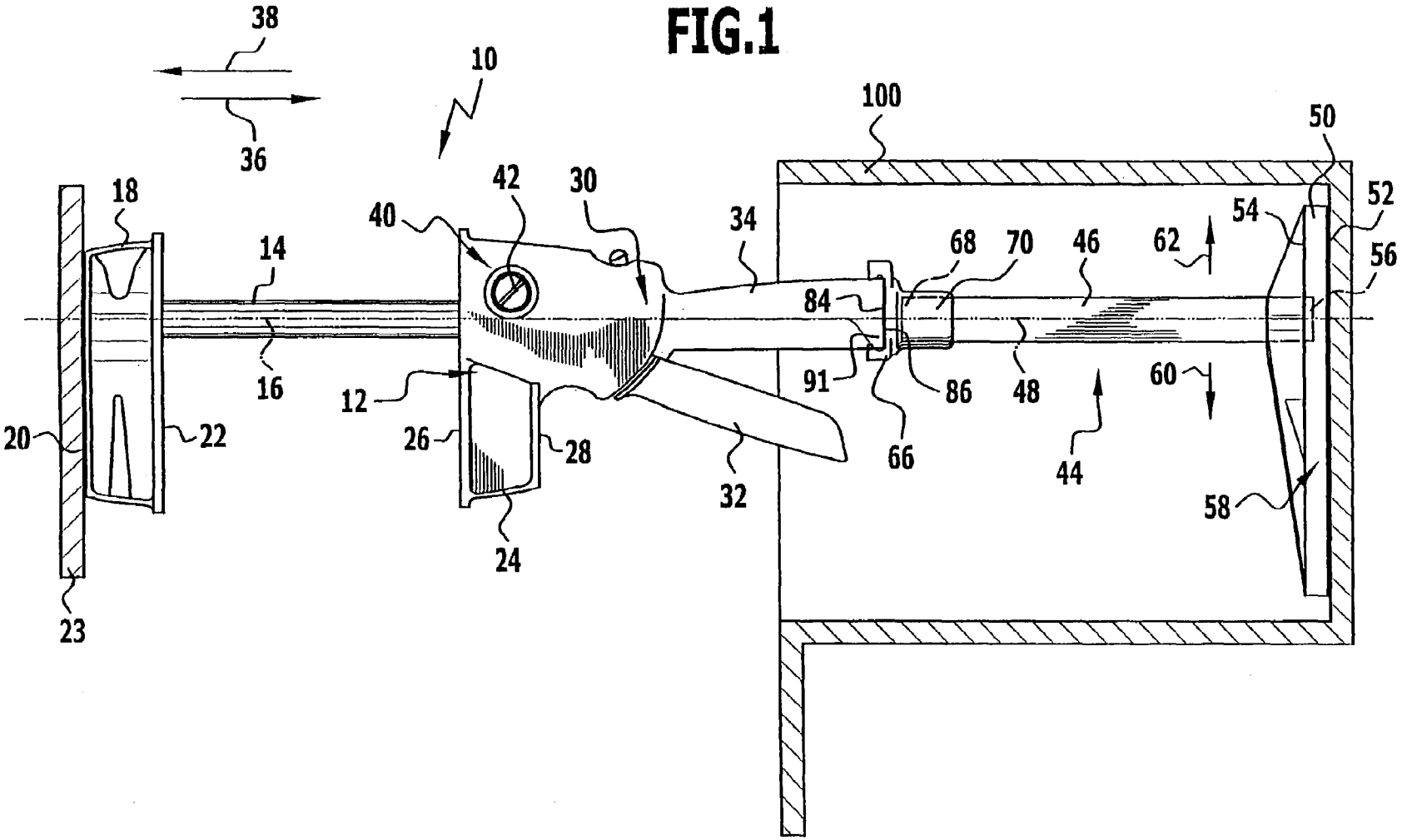
FIG. 1 shows a side view of one embodiment of an inventive clamping and spreading device with one embodiment of an extension device fixed in position.

One embodiment of a clamping and spreading device in accordance with the invention, which is shown in FIG. 1 and designated as a whole as 10, comprises a bearing device 12. A slide rail 14 is mounted for displacement on this bearing device 12. The slide rail 14 extends in a longitudinal axis 16 and is slidingly displaceable in the direction of this longitudinal axis 16.

A first contact element 18, which is designed, in particular, as a transverse bar, is seated at or in the vicinity of one end of the slide rail 14. This first contact element 18 has a first contact surface 20 (contact area) and a second contact surface 22 (contact area) located opposite thereto. The first contact surface 20 which abuts on a workpiece 23 in the illustration shown in FIG. 1 can be used, in particular, for a spreading procedure. The second contact surface 22 can be used for a clamping procedure.

A second contact element 24 is arranged on the bearing device 12 and this element has a first contact surface 26 (contact area) and a second contact surface 28 (contact area) located opposite thereto. The first contact surface 26 of the second contact element 24 faces the second contact surface 22 of the first contact element 18. A workpiece can be clamped between the contact surfaces 22 and 26. The second contact surface 28 of the second contact element 24 may be used as a contact surface for a spreading procedure.

An actuating device 30 is formed on the bearing device 12 for actuating the displacement movement of the slide rail 14 on the bearing device 12. The actuating device 30 comprises, for example, a gripping lever 32 which is arranged so as to be pivotable and a counter-gripping element 34. The counter-gripping element 34 extends essentially parallel or coaxially to the longitudinal axis 16 of the slide rail 14. The slide rail 14 is guided for displacement by the counter-gripping element 34. The counter-gripping element 34 can have one or several bearing points for the slidingly displaceable mounting of the slide rail 14.

An operator of the clamping and spreading device 10 can hold this with one hand at the counter-gripping element 34 and actuate the gripping lever 32 with his fingers and, in particular, pivot it against the counter-gripping element 34.

The actuating device 30 has a mechanism for effecting a displacement movement of the slide rail 14 via pivoting of the gripping lever 32.

One embodiment of such a mechanism and a corresponding clamping and spreading device is disclosed in German patent application No. 10 2004 013 066.3 of Mar. 12, 2004, which is not a prior publication. Reference is expressly made to this application. Additional examples for such mechanisms are disclosed in WO 01/56747 A1 or U.S. Pat. No. 6,575,442 B2.

The actuating device 30 is designed, in particular, such that a displacement movement of the slide rail 14 in a clamping direction 36 can be actuated and the displaceability in the opposite direction 38 thereby blocked. When the displacement movement of the slide rail 14 is actuated in the clamping direction 36, the first contact element 18 moves towards the second contact element 24 so that a workpiece can be clamped between the two contact elements 18 and 24.

Furthermore, the actuating device 30 is designed such that the slide rail 14 is movable in a spreading direction 38 and the displaceability in the opposite direction 36 is thereby blocked. When this displacement movement is actuated, the first contact element 18 moves away from the second contact element 24 and a spreading force can be exerted on one or several workpieces which abut on the contact surfaces 20 and 28.

The actuating device comprises a changeover device 40 with a changeover device 42, via which it is possible to switch over from the displacement of the slide rail 14 in the clamping direction 36 into a displacement in the spreading direction 38 and vice versa. A changeover in the blocking direction is brought about at the same time as the changeover in the direction of displacement.

Examples for changeover devices are disclosed in the German patent application No. 10 2004 013 066.3 of Mar. 12, 2004, which is not a prior publication, and WO 01/56747 A1 or U.S. Pat. No. 6,575,442 B2, to which reference is expressly made.

The bearing device 12 is that element of the clamping and spreading device 10, with respect to which the slide rail 14 is mounted. The bearing device 12 comprises the bearing or bearings for the slide rail 14 itself. The actuating device 30 is formed on it or connected to it. Furthermore, the second contact element 24 is formed on it or connected to it. The gripping lever 32 and the counter-gripping element 34 are also formed on the bearing device 12 or connected to it.

In accordance with the invention, an extension device is provided which is designated in FIG. 1 as a whole as 44. This extension device 44 comprises an extension element 46 which extends in the direction of a longitudinal axis 48 which is essentially parallel or coaxial to the longitudinal axis 16 of the slide rail 14.

A contact element 50, which can abut on a workpiece, is seated on the extension device 44. For this purpose, the contact element 50 has a contact surface 52 (first contact surface).

It may be provided for the contact element 50 to also have a second contact surface 54 located opposite thereto.

The contact element 50 is seated on the extension element 46 at or in the vicinity of an end 56 of this extension element 46. It is arranged at a distance in relation to the first contact element 18 and at a distance to the second contact element 24. The first contact element 18 and the contact element 50 are positioned on opposite sides with respect to the bearing device 12.

The contact element 50 is formed, for example, by a contact surface at the end 56 of the extension element 46 (not shown in the drawings).

In the embodiment shown, the contact element 50 is designed as a transverse bar 58 which extends transversely to the longitudinal axis 48.

It can, in principle, be provided for the transverse bar 58 to be arranged so as to be movable and securable on the extension element 46. For example, it is arranged so as to be rotatably securable on the extension element 46 and/or so as to be displaceable in a translational manner and securable. When a securable movability is provided, a desired rotary position and/or translational position of the transverse bar 58 on the extension element 46 can be set.

It is alternatively possible for the transverse bar 58 to be rigidly seated on the extension element 46, wherein its position relative to the extension element 46 cannot be altered.

The contact element 50 is designed, for example, such that it has in a transverse direction 60 in relation to the longitudinal axis 48 of the extension element 46 (wherein the transverse direction 60 is, in particular, at right angles to the longitudinal axis 48) a greater height with respect to the longitudinal axis 48 than in an opposite direction 62.

The extension of the transverse bar 58 in the direction 62 is, for example, in relation to the longitudinal axis 16 of the slide rail 14 when the extension device 44 is fixed in position on the clamping and spreading device 10 such that it corresponds to an extension of the first contact element 18 and/or the second contact element 24 in the same direction. With a corresponding orientation of the transverse bar 58, the clamping and spreading device 10 with an extension device 44 fixed in position can be placed flat on a base.

(In FIG. 1, a design of the contact element 50 is shown, with which no such adaptation of the contact element 50 in relation to the first contact element 18 and/or the second contact element 24 is provided).

The transverse bar 58 is produced, for example, from plastic and subsequently fixed to the extension element 46.

The extension element 46 is of a tubular design in the embodiment shown with a tube axis which coincides with the longitudinal axis 48. The extension element 46 has an at least approximately hollow cylindrical inner space 64 (FIGS. 3 and 4), into which the slide rail 14 can dip when the first contact element 18 is moved towards the second contact element 24 with an extension device 44 fixed in position, i.e., the slide rail is moved in the clamping direction 36. As a result, the slide rail is moved in the direction of the contact element 50. As a result of the inner space 64, which can accommodate the slide rail 14, it is ensured that the extension element 46 does not hinder the displacement movement of the slide rail 14.

When the extension device 44 is fixed on the clamping and spreading device 10, the longitudinal axis 16 of the slide rail 14 and the longitudinal axis 48 of the extension element 46 are oriented essentially parallel or coaxial to one another.

It is, in principle, possible for the extension device 44 to be fixed in position so as to be unreleasable in relation to the bearing device 12. The extension device 44 is connected, in particular, to the counter-gripping element 34.

It is advantageous when the extension device 44 can be fixed in position so as to be releasable. The clamping and spreading device 10 may then be provided with the extension device 44 in a simple manner when necessary for applications.

In order to connect the extension device 44 to the bearing device 12 and, in particular, the gripping element 34, a coupling 66 is provided which is arranged at an end 68 of the extension element 46 located opposite the end 56. The coupling 66 is, for example, a plastic part which is pushed onto the extension element 46.

Figure 4:
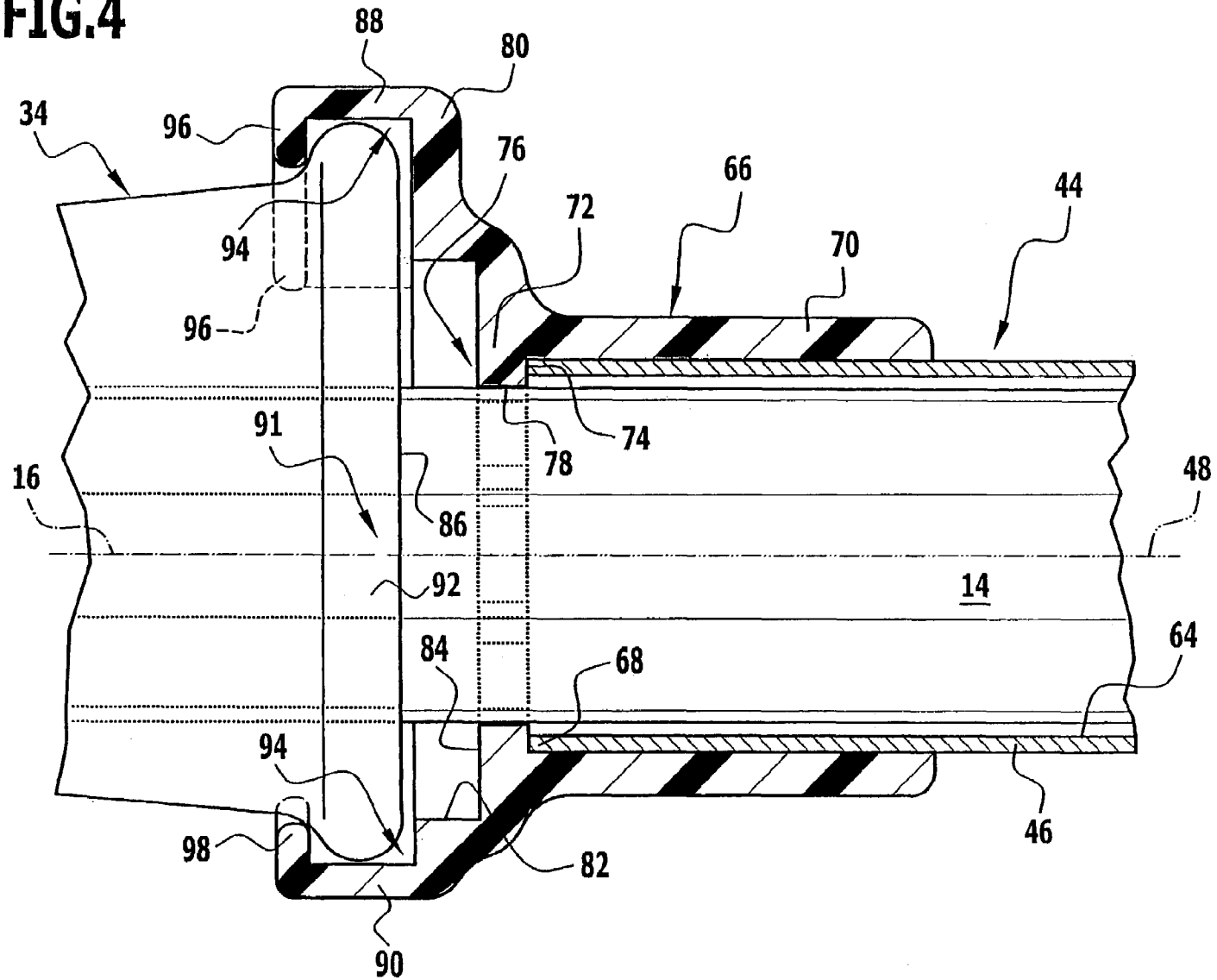
FIG. 4 shows a sectional view along line 4—4 according to FIG. 3.
Figure 5:
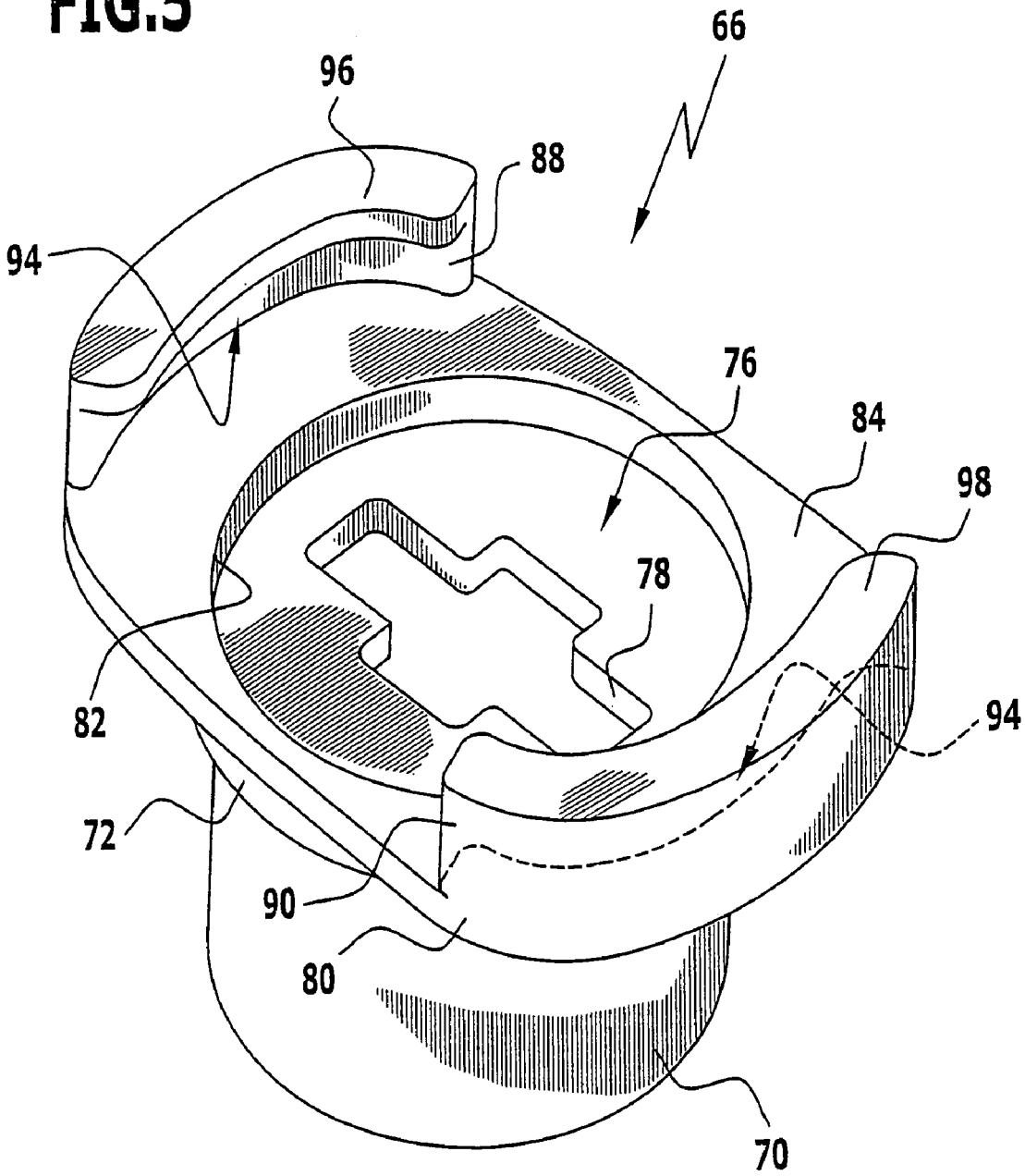
FIG. 5 shows a perspective illustration of one embodiment of a coupling for connecting the extension device to the clamping and spreading device.

The coupling 66 (FIGS. 4 and 5) has a first cylindrical area 70, by means of which it can be pushed onto the extension element 46. For example, the area 70 is designed to consist of such a material that the coupling 66 can be shrunk onto the extension element 46 with the area 70; it may also be provided for the area 70 to be produced from an elastic material and for a diameter to be adjusted in relation to an outer diameter of the extension element 46 such that the coupling 66 is held clamped on the extension element 46 with the area 70 via elastic forces.

The area 70 is adjoined by an annular area 72, via which a step 74 is formed at the transition to the area 70. A contact surface to the end face 68 of the extension element 46 is made available via this step 74 in order to block the displacement of the coupling 66 on the extension element 46 in the direction of the contact element 50.

The area 72 is designed as a guide element 76 for the slide rail 14. The slide rail 14 is profiled. The guide element 76 has a guide opening 78, through which the slide rail can be guided when an extension device 44 is fixed in position so that the slide rail can dip into the inner space 64 of the extension element 46. The guide recess 78 is, however, designed such that the slide rail 14 is essentially not rotatable relative to the coupling 66 when an extension device 44 is fixed in position. (The guide recess 78 is designed such that the slide rail 14 has clearance when it is located in the guide recess 78. This clearance allows rotation at the most at a very small angle. The term "essentially" is to be understood such that clearance is allowed).

An additional, annular area 80 adjoins the area 72 of the coupling 66. When the coupling 66 is seated on the extension element 46, this area 80 is then located at a distance from the end 68 of the extension element 46.

A recess 82, through which the slide rail 14 can be guided, is formed at the area 80.

Furthermore, a contact surface 84 is formed via the area 80 and this is adapted to a corresponding end face 86 of the counter-gripping element 34. The extension device 44 can abut against the counter-gripping element 34 at its end face via the contact surface 84.

A first flange 88 and a second flange 90 located opposite thereto are connected to the area 80 and these flanges can engage over the counter-gripping element 34 and, in particular, engage over it on diametrically opposite sides (in relation to the longitudinal axis 16).

It is favorably provided for the counter-gripping element 34 to have at or in the vicinity of its end face 86 a counter-coupling 91, such as, for example, a circumferential edge bead 92. The flanges 88, 90 are designed such that they can engage over the edge bead 92. For this purpose, a receiving space 94 for the counter-gripping element 34 with its edge bead 92 is formed between the flanges 88 and 90. This receiving space 94 is limited by the contact surface 84. When the edge bead 92 is seated in this receiving space 94, the translational movement of the counter-gripping element 34 (and, therefore, of the clamping and spreading device 10) is blocked in the direction of the contact element 50 of the extension device 44 by the contact surface 84. The translational movement in the opposite direction is blocked by the flanges 88, 90; these have, for this purpose, respective contact elements 96, 98 which cover the receiving space 94 and make blocking surfaces available when the counter-gripping element 34 with its edge bead 92 is seated in a fixing position in the receiving space 94.

The areas 70, 72, 80 and the flanges 88 and 90 are, in particular, connected to one another in one piece so that the coupling 66 is an integral part.

The first flange 88 and the second flange 90 are preferably designed so as to be adapted to one another and adapted to the counter-gripping element 34 such that the extension device can be turned onto the counter-gripping element 34 in order to fix this on the clamping and spreading device 10, i.e., to fix it in a non-translational manner in relation to the bearing device 12. The edge bead 92 is brought into the receiving space 94 due to the turning on of the extension device, namely in such a manner that the contact elements 96 and 98 represent blocking elements for any movement of the counter-gripping element 34 away from the coupling 66.

It is advantageous when the coupling 66 with its flanges 88 and 90 is designed such that the extension device 44 can be fixed in two different positions on the counter-gripping element 34. This is advantageous when the contact element 50 is not designed to be mirror symmetrical to the longitudinal axis 48 of the extension element 46. An operator then has the choice of positioning the contact element 50 in two different positions in relation to the bearing device 12. It is possible, in particular, to position that part of the contact element 50 which has the greater height in relation to the longitudinal axis 16 of the slide rail 14 on the side of the gripping lever 32 or on the side located opposite thereto.

The inventive extension device 44 functions as follows:

Without an extension device 44 fixed on the clamping and spreading device 10 the maximum clamping width (the distance between the contact surface 22 and the contact surface 26) is determined by the maximum, pulled-out position of the slide rail 14 on the bearing device 12. The greatest spreading width (the distance between the contact surfaces 20 and 28) is determined in a similar manner by the maximum, pushed-out position of the slide rail 14 in relation to the bearing device 12.

As a result of the inventive extension device 44, the clamping width and the spreading width may be increased, wherein this increase is essentially determined by the length of the extension element 46 in the direction of the longitudinal axis 48. This length may be varied for different applications. For example, a set of extension devices 44 of different lengths may be kept available.

The maximum possible clamping width is then determined by the distance between the contact surface 22 and the contact surface 54. In a corresponding way, the maximum spreading width is determined by the distance between the contact surface 20 and the contact surface 52 of the contact element 50.

Since the extension device can be fixed or is fixed in position so as to be non-translational in relation to the bearing device 12 and the slide rail 14 is displaceable in relation to the bearing device 12, the distance between the first contact element 18 and the contact element 50 is altered with displacement of the slide rail 14. As a result, a clamping procedure or spreading procedure may be carried out when the contact element 50 abuts accordingly on a workpiece 100. The workpiece 100 may be separate from the workpiece 23 or it may also be the same workpiece. In the same way as the relative distance to the second contact element 26 (which is connected in a non-translational manner in relation to the bearing device 12) is altered as a result of the displacement of the slide rail 14 in the clamping direction 36 or in the spreading direction 38, the relative distance to the contact element 50 is also altered, wherein the range of use is increased due to the increase in the clamping width or spreading width.

For example, it is possible to carry out a spreading procedure in a body, into which the clamping and spreading device 10 with an extension device 44 fixed in position can be inserted.

The extension device 44 may be fixed to the counter-gripping element 34 of the clamping and spreading device 10 via the coupling 66 and the adapted edge bead 92.

When the extension device 44 is fixed on the counter-gripping element 34, the slide rail 14 can dip into the inner space 64 of the extension element 46 when the slide rail 14 is moved to such an extent in the direction towards the second contact element 24 that it projects beyond the counter-gripping element 34. (It is favorable when the slide rail 14 is guided and, in particular, is mounted on the counter-gripping element 34 for sliding displacement.)

In order to fix the extension device 44 on the counter-gripping element 34 and, as a result, in a non-translational manner in relation to the bearing device 12, the slide rail 14 is, for example, displaced to such an extent that it no longer projects beyond the counter-gripping element 34. The coupling 66 is then placed onto the counter-coupling 91 and the edge bead 92 is brought into the receiving space 94. In the fixing position of the coupling 66 (and, therefore, of the extension device 44), the guide recess 78 is aligned such that the slide rail 14 can pass through it.

Figure 2:
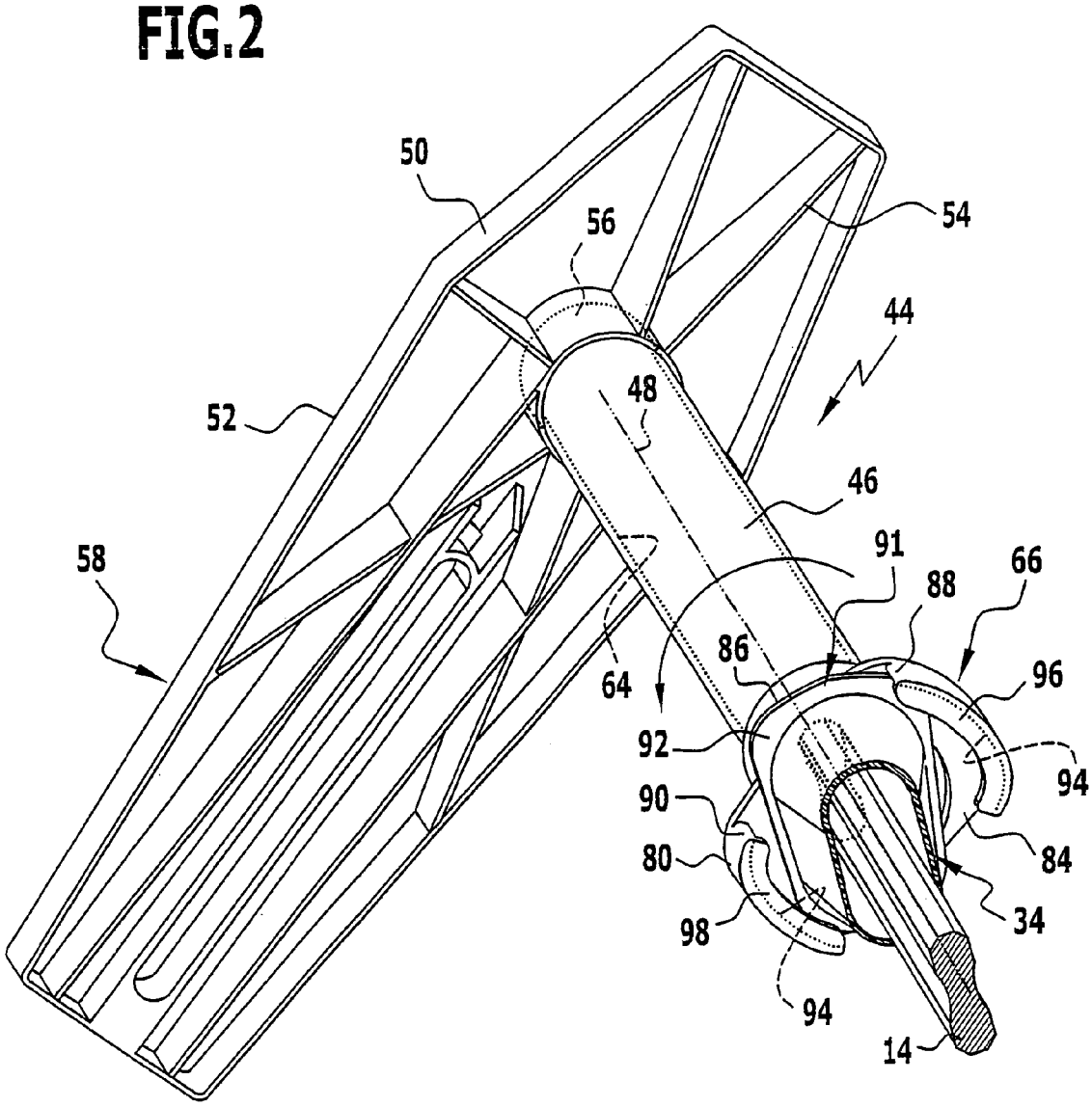
FIG. 2 shows a perspective illustration of the extension device according to FIG. 1 and part of the clamping and spreading device according to FIG. 1 during a fixing procedure.

FIG. 2 shows an intermediate position, in which the extension device 44 with the coupling 66 is turned onto the counter-coupling 91 of the counter-gripping element 34.

Figure 3:
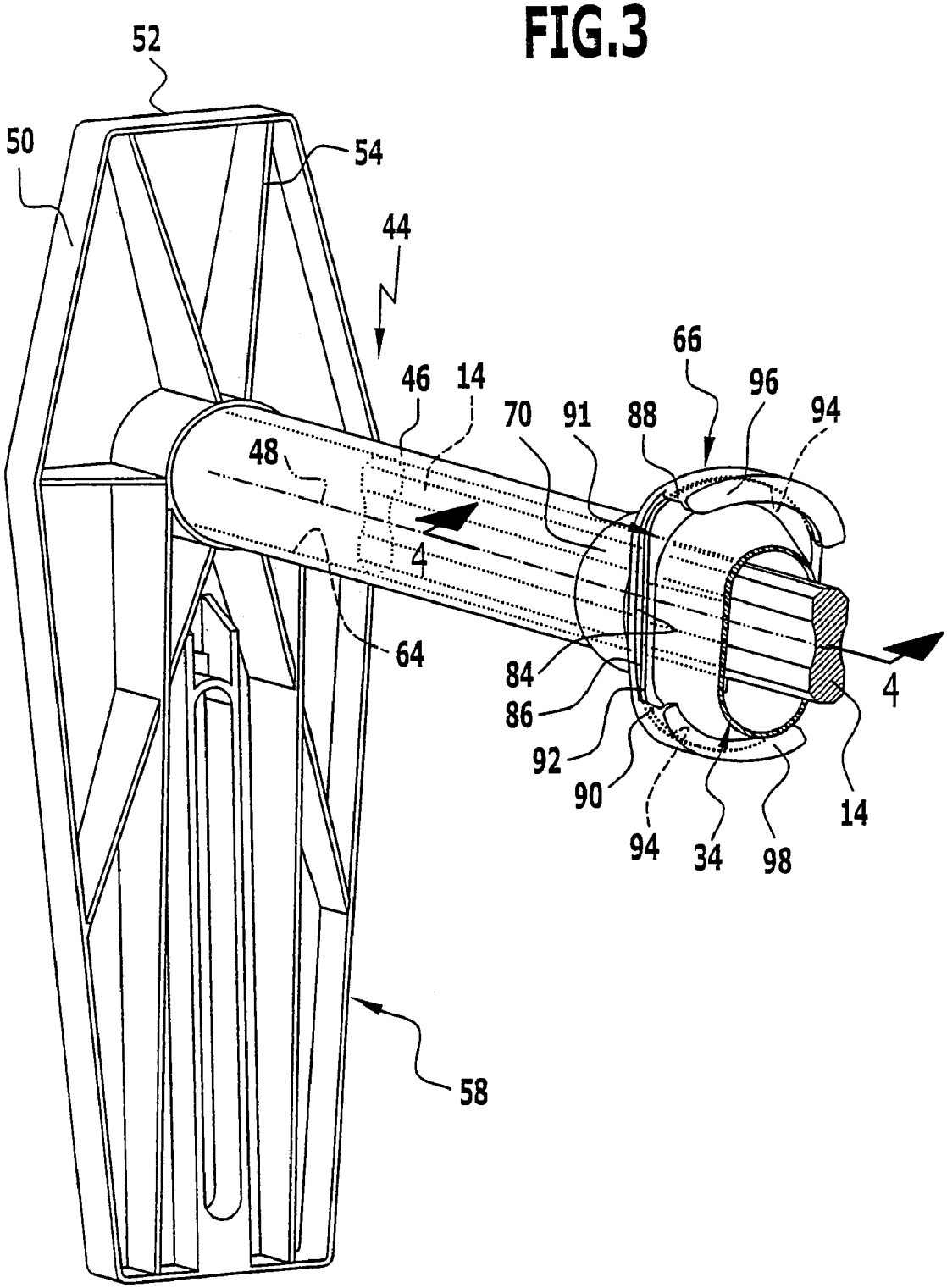
FIG. 3 shows a similar view to FIG. 2 after a successful fixing in position.

FIG. 3 shows the turned-on position, in which the edge bead 92 is located in the receiving space 94 and the guide recess 78 is aligned in relation to the slide rail 14 so that this can dip into the inner space 64 of the extension element 46.

Figure 6:
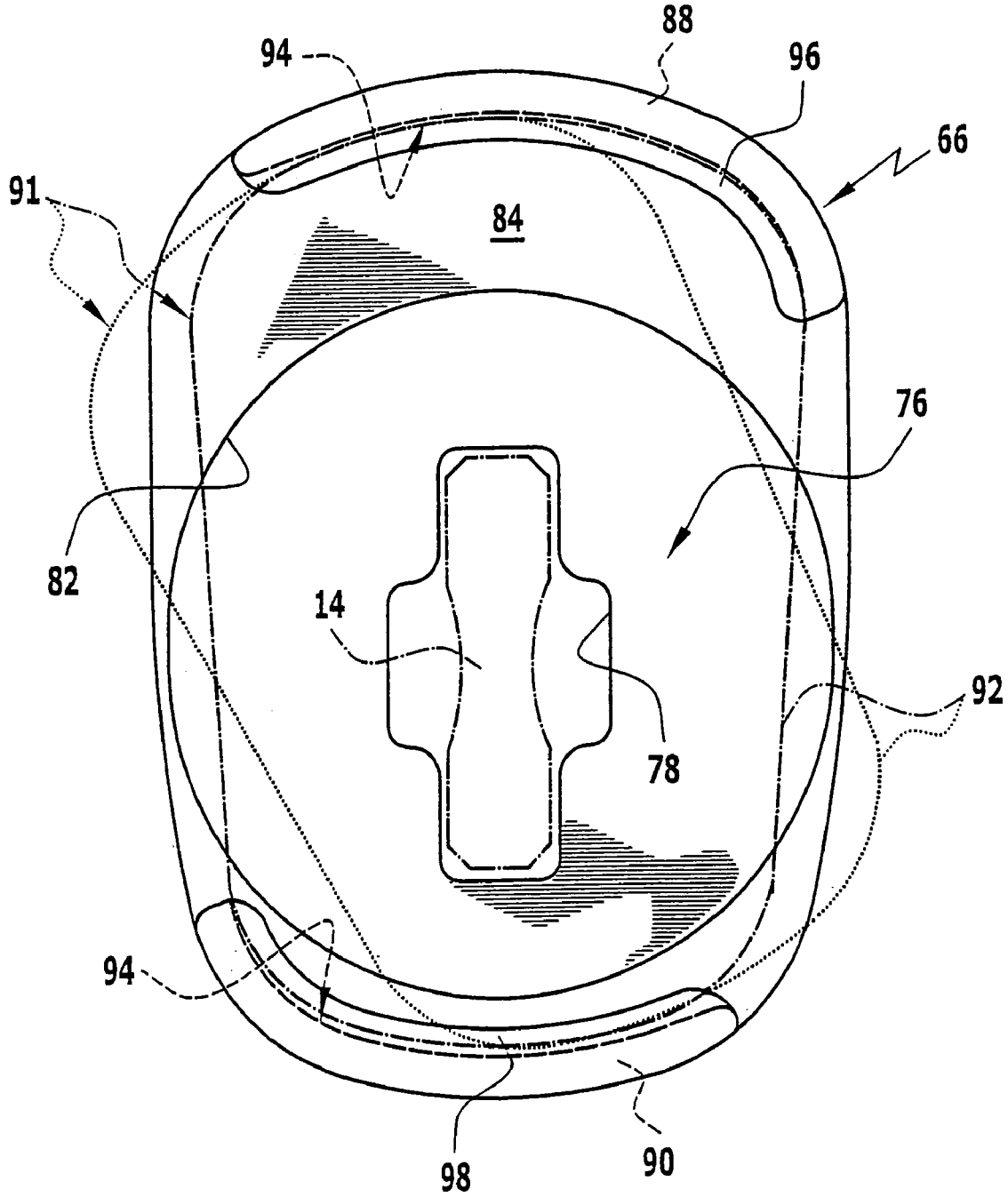
FIG. 6 shows a sectional view of the coupling according to FIG. 5 during the fixing to the clamping and spreading device and in an intermediate state and FIG. 7 shows a schematic illustration of an additional embodiment of an inventive extension device.

The intermediate position is indicated again in FIG. 6 by dotted lines.

When the slide rail dips into the guide recess 78, the rotatability of the extension device 44 relative to the slide rail 14 is blocked apart from a certain clearance. As a result, the rotatability of the extension device 44 is blocked in relation to the bearing device 12.

The flanges 88 and 90 may be designed such that the counter-gripping element 34 can be turned on with the edge bead 92 until the continued rotation is blocked.

Such a blocking surface for blocking the rotatability is not absolutely necessary. The blocking of the rotatability by the guide recess 78 when the slide rail 14 dips into it is, in principle, sufficient.

The translational movement of the extension device 44 relative to the counter-gripping element 34 is blocked via the flanges 88 and 90.

In accordance with the invention, a clamping and spreading device is made available, by means of which broader possibilities for use are provided when an extension device 44 is fixed in position.

Particularly when the extension device 44 is separate from the clamping and spreading device 10 and can be fixed to it in a releasable manner, the possibilities for using the clamping and spreading device 10 may be broadened in a simple manner.

The extension device is or will be mounted so as to be non-translational in relation to the bearing device which provides for the sliding displaceability of the slide rail. In the embodiment shown, assembly on a counter-gripping element is provided. Other types of assembly are also possible, such as, for example, a housing of the bearing device or a housing, in which the bearing device is arranged. The extension device may also be mounted in the same way, for example, on the clamping and spreading device according to WO 01/56747 A1 or U.S. Pat. No. 6,575,442 B2.

Figure 7:
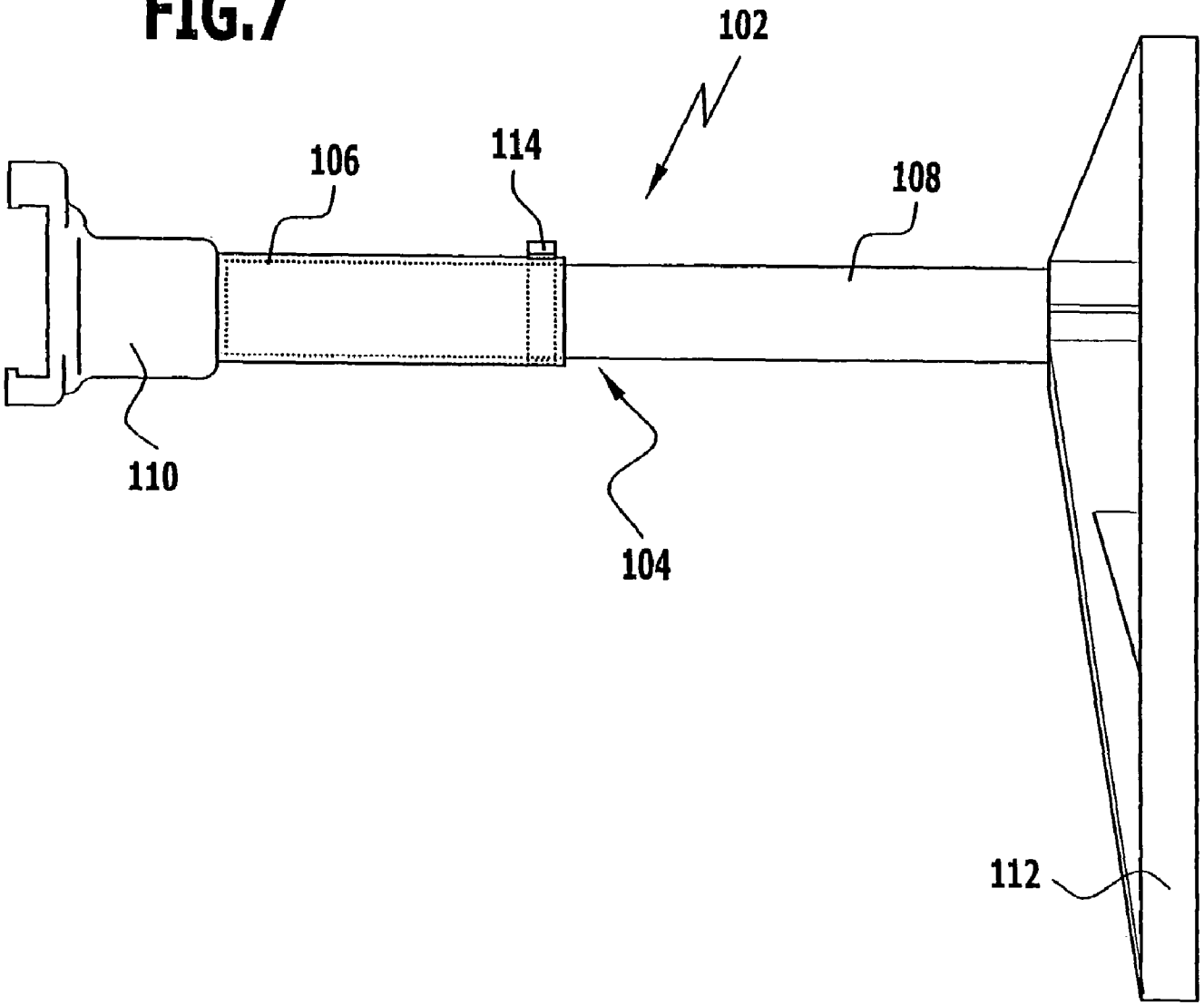

The extension device can, itself, have a variable, adjustable length (parallel to the longitudinal axis of the slide rail 14). This will be described on the basis of an additional embodiment of an extension device which is shown in FIG. 7 and designated as a whole as 102. This extension device 102 has an extension element 104 which is designed in several parts. In the embodiment shown, the extension element 104 is designed in two parts. In principle, more than two parts can also be provided.

The extension element 104 comprises a tubular, first extension part 106 and a tubular, second extension part 108. A coupling 110, which is, in principle, of the same design as the coupling 66 described above, is seated on the first extension part 106. The extension device 102 can be fixed to the clamping and spreading device 10 via the coupling 110.

A contact element 112, which is, in principle, of the same design as the transverse bar 58 described above, is seated on the second extension part 108.

The first extension part 106 forms an outer tube, into which the second extension part 108 can dip. The slide rail 14 can dip into the first extension part 106 and the second extension part 108.

The length of the extension element 104 and, therefore, the length of the extension device 102 can be adjusted by adjusting the insertion depth of the second extension part 108 in the first extension part 106.

For example, a specific displacement position of the second extension part 108 in relation to the first extension part 106 may be secured via a clip 114. For this purpose, continuous recesses are formed, for example, in the second extension part 108, into which elements of the clip 114 can be guided. Furthermore, the first extension part 106 comprises a corresponding recess. Once the insertion elements of the clip 114 have dipped into the continuous recesses of the second extension part 108, a specific length of the extension element 104 is fixed via the relative position of the first extension part 106 and the second extension part 108 in relation to one another.

The recesses in the second extension part 108 are arranged such that the displaceability of the slide rail in the extension element 104 is not hindered when a clip 114 engages therein.

The length of the extension element 104 may be adjusted in steps as a result of spaced recesses in the second extension part 108. A step-less adjustability of the length may also be provided. For this purpose, a clamping device is provided, for example, by means of which the second extension part 108 and the first extension part 106 may be clamped to one another in every relative position in a displacement area.

The invention claimed is:

1. Extension device for a clamping and spreading device, said clamping and spreading device having a bearing device and a slide rail guided for displacement in relation to the bearing device, comprising:

at least one contact element for a workpiece;

wherein:

said extension device is fixed or is fixable in a non-translational manner in relation to the bearing device, a coupling for fixing the extension device in relation to the bearing device is provided, and at least one guide element for the slide rail is arranged or formed on the coupling.

2. Extension device as defined in claim 1, wherein the extension device is designed such that at least one of a clamping width and a spreading width of the clamping and spreading device with an extension device fixed in position is increased in comparison with the clamping and spreading device without an extension device.

3. Extension device as defined in claim 1, wherein the extension device is designed such that with an extension device fixed in position on the clamping and spreading device an outer end of the combination of clamping and spreading device and extension device is formed to one side on the extension device.

4. Extension device as defined in claim 1, wherein the at least one contact element is arranged or formed at or in the vicinity of an outer end of the extension device.

5. Extension device as defined in claim 1, wherein the at least one contact element is designed as a transverse bar.

6. Extension device as defined in claim 1, wherein the at least one contact element has a first contact area and a second contact area located opposite to the first contact area.

7. Extension device as defined in claim 1, wherein an extension element extending in the direction of a longitudinal axis is provided.

8. Extension device as defined in claim 7, wherein the at least one contact element is arranged or formed on the extension element.

9. Extension device as defined in claim 7, wherein the at least one contact element is arranged on the extension element so as to be movable and securable.

10. Extension device as defined in claim 7, wherein the extension element is designed such that a relative displacement movement of the slide rail in relation to the extension element is not hindered.

11. Extension device as defined in claim 7, wherein the extension element is of a tubular design.

12. Extension device as defined in claim 7, wherein the extension element has an inner space, the slide rail being able to dip into said inner space.

13. Extension device as defined in claim 1, wherein at least one guide element for the slide rail is provided, said guide element being designed such that a relative rotation between the slide rail and the extension device is essentially blocked when the slide rail is located in the guide element.

14. Extension device as defined in claim 1, wherein said extension element is designed such that it is releasably fixable in position in relation to the bearing device.

15. Extension device as defined in claim 1, wherein the coupling is seated on an extension element.

16. Extension device as defined in claim 1, wherein the coupling is designed such that the extension device is adapted to be fixed in position in relation to the bearing device in at least two different positions of the at least one contact element relative to the bearing device.

17. Extension device as defined in claim 1, wherein the coupling has a contact area adapted to a fixing area of the clamping and spreading device.

18. Extension device for a clamping and spreading device, said clamping and spreading device having a bearing device and a slide rail guided for displacement in relation to the bearing device, comprising:

at least one contact element for a workpiece, wherein:

said extension device is fixed or is fixable in a non-translational manner in relation to the bearing device, a coupling for fixing the extension device in relation to the bearing device is provided, and the coupling is designed such that it is adapted to be turned onto a fixing area of the clamping and spreading device.

19. Extension device as defined in claim 1, wherein the coupling has at least one flange engaging over a fixing area of the clamping and spreading device.

20. Extension device as defined in claim 19, wherein two flanges located opposite one another are provided.

21. Extension device as defined in claim 15, wherein the coupling is arranged on the extension element in a push-on or slip-on manner.

22. Clamping and spreading device, comprising:

a bearing device;

a slide rail guided for displacement in relation to the bearing device; and an extension device;

the extension device having at least one contact element for a workpiece and being fixed or fixable in a non-translation manner in relation to the bearing device;

the displacement movement of the slide rail being actuatable in a clamping direction with blocking of the displaceability in an opposite spreading direction, and actuatable in said spreading direction with blocking of the displaceability in the clamping direction, the displacement movement being adapted to be switched over between the clamping direction and the spreading direction via a changeover device.

23. Clamping and spreading device as defined in claim 22, wherein a first contact element is arranged on the slide rail.

24. Clamping and spreading device as defined in claim 22, wherein a second contact element is arranged so as to be non-translational in relation to the bearing device.

25. Extension device as defined in claim 22, wherein a coupling for fixing the extension device in relation to the bearing device is provided.

26. Extension device as defined in claim 25, wherein at least one guide element for the slide rail is arranged or formed on the coupling.

27. Clamping and spreading device, comprising:

a bearing device;

a slide rail guided for displacement in relation to the bearing device;

a first contact element arranged on the slide rail;

a second contact element arranged so as to be non-translational in relation to the bearing device; and an extension device having at least one contact element for a workpiece, said extension device being fixed or fixable in a non-translation manner in relation to the bearing device;

wherein the at least one contact element of the extension device has a greater height in at least one direction than at least one of the first contact element and the second contact element in relation to a longitudinal axis of the slide rail when the extension device is fixed in position.

28. Clamping and spreading device as defined in claim 25, wherein the at least one contact element of the extension device has essentially the same height in at least one direction as at least one of the first contact element and the second contact element in relation to a longitudinal axis of the slide rail when an extension device is fixed in position.

29. Clamping and spreading device as defined in claim 22, wherein a coupling or a counter-coupling non-translational in relation to the bearing device is provided for a releasable fixing in position of the extension device.

30. Clamping and spreading device as defined in claim 22, wherein a gripping lever is provided for actuation of the displacement of the slide rail.

31. Clamping and spreading device as defined in claim 30, wherein a counter-gripping element to the gripping lever is provided, the slide rail being guided on said element.

32. Clamping and spreading device, comprising:

a bearing device;

a slide rail guided for displacement in relation to the bearing device;

a gripping lever for actuation of the displacement of the slide rail;

a counter-gripping element to the gripping lever, the slide rail being guided on said counter-gripping element; and an extension device having at least one contact element for a workpiece, the extension device being fixed or fixable on the counter-gripping element in a non-translation manner in relation to the bearing device.

33. Clamping and spreading device as defined in claim 31, wherein the counter-gripping element has an edge bead for fixing the extension device in position.

34. Clamping and spreading device as defined in claim 23, wherein an extension element of the extension device extends essentially parallel or coaxially to the slide rail when an extension device is fixed in position.

* * * * *

UNITED STATES PATENT AND TRADEMARK OFFICE

CERTIFICATE OF CORRECTION

PATENT NO. : 7,226,046 B2
APPLICATION NO. : 11/066343
DATED : June 5, 2007
INVENTOR(S) : Kloepfer et al.

It is certified that error appears in the above-identified patent and that said Letters Patent is hereby corrected as shown below:

Column 14, line 60: correct "as defined in claim 25" to read -- as defined in claim 27 --.

Signed and Sealed this

First Day of April, 2008

JON W. DUDAS
*Director of the United States Patent and Trademark Office*